US007988826B2

(12) United States Patent
Inaoka et al.

(10) Patent No.: US 7,988,826 B2
(45) Date of Patent: Aug. 2, 2011

(54) CATIONIC SURFACE SIZING AGENT AND PAPER COATED WITH THE SAME

(75) Inventors: Kazushige Inaoka, Kakogawa (JP); Tomohiko Nakata, Kakogawa (JP); Yoshiharu Hashiguchi, Kakogawa (JP)

(73) Assignee: Harima Chemicals, Inc., Hyogo (JP)

( * ) Notice: Subject to any disclaimer, the term of this patent is extended or adjusted under 35 U.S.C. 154(b) by 255 days.

(21) Appl. No.: 12/225,727

(22) PCT Filed: Mar. 30, 2006

(86) PCT No.: PCT/JP2006/306690

§ 371 (c)(1),
(2), (4) Date: Sep. 29, 2008

(87) PCT Pub. No.: WO2007/116446

PCT Pub. Date: Oct. 18, 2007

(65) Prior Publication Data

US 2009/0272507 A1 Nov. 5, 2009

(51) Int. Cl.
*D21H 19/20* (2006.01)

(52) U.S. Cl. ..... 162/135; 162/168.1; 162/168.2; 162/169; 427/391; 526/307; 526/310; 526/312; 526/319

(58) Field of Classification Search ..... 162/135, 162/168.2, 169, 184, 168.1; 427/385.5, 389.5, 427/391, 394, 395, 389.9; 526/307, 310, 526/312, 317, 319, 328.5, 329, 329.2, 329.7
See application file for complete search history.

(56) References Cited

U.S. PATENT DOCUMENTS

| | | | | |
|---|---|---|---|---|
| 4,943,608 | A * | 7/1990 | Takahashi et al. | 524/272 |
| 5,954,921 | A * | 9/1999 | Dahmen et al. | 162/168.2 |

FOREIGN PATENT DOCUMENTS

| | | |
|---|---|---|
| JP | 56-118994 | 9/1981 |
| JP | 60-155798 | 8/1985 |
| JP | 63-251409 | 10/1988 |
| JP | 2-26997 | 1/1990 |
| JP | 3-167397 | 7/1991 |
| JP | 4-34097 | 2/1992 |
| JP | 9-505005 | 5/1997 |
| JP | 11-256496 | 9/1999 |
| JP | 11-279983 | 10/1999 |
| JP | 11-323774 | 11/1999 |
| JP | 2001-262495 | 9/2001 |
| JP | 2001-295197 | 10/2001 |
| JP | 2002-129494 | 5/2002 |
| JP | 2005-248338 | 9/2005 |
| JP | 2006-16712 | 1/2006 |
| JP | 2006-161259 | 6/2006 |

* cited by examiner

*Primary Examiner* — Eric Hug
*Assistant Examiner* — Peter Chin
(74) *Attorney, Agent, or Firm* — Clark & Brody

(57) ABSTRACT

The invention improves a sizing effect even on paper containing no internal sizing agent and improves productivity by making solution polymerization in a small amount of an organic solvent. The invention provides a cationic surface sizing agent composed of a copolymer obtained by solution polymerization of (a) 15 to 35% by weight of a tertiary amino group-containing monomer, (b) 30 to 85% by weight of $C_1$ to $C_4$ alkyl(meth)acrylate, and (c) 1 to 50% by weight of styrenes in an organic solvent in the presence of a chain transfer agent. The copolymer may be subjected to cationization treatment with a quaternization agent. As a constituent monomer of the copolymer, 0 to 20% by weight of another copolymerizable vinyl monomer (d) may be contained. The cationic surface sizing agent is applied to paper.

6 Claims, No Drawings

CATIONIC SURFACE SIZING AGENT AND PAPER COATED WITH THE SAME

TECHNICAL FIELD

The invention relates to a cationic surface sizing agent and paper products coated with the sizing agent. Particularly, a cationic surface sizing agent can impart excellent sizing efficiency even on papers without internal sizing agent or with extremely low Stockigt sizing degree and it is possible to remove a solvent distillation step or to simplify by decreasing the amount of the solvent at the time of polymerization for the cationic surface sizing agent.

BACKGROUND ART

As cationic surface sizing agents, quaternary cationic copolymers obtained by copolymerizing styrenes and tertiary amino group-containing monomers and emulsions obtained by polymerization of hydrophobic monomers in the presence of the cationic copolymers have been known so far. Specific examples thereof are as follows.

(1) Patent Document 1

As an object of improving sizing effect, a surface sizing agent obtained by mixing cationic hydrophobic polymers obtained by polymerization reaction of (a) 90 to 60% by mole of styrenes, (b) 0 to 30% by mole of tertiary or quaternary amino-containing monomers, and (c) 0 to 10% by mole of other vinyl monomers (such as (meth)acrylic esters, vinyl acetate, acrylonitrile, acrylamides, (meth)acrylic acid) in an organic solvent with cationized starch are disclosed (reference to claims 1 to 6, paragraphs 6 to 7).

(2) Patent Document 2

As an object of imparting a good sizing property and dissociation property to a manufactured paper, disclosed is a cationic polymer emulsion, which is usable as an internal sizing agent or a surface sizing agent, obtained by adding copolymers to water wherein the copolymers are composed of constituent monomers including (1) 50 to 98.5% by mole of styrenes, (2) 0.1 to 9.9% by mole of dialkylaminoalkyl (meth)acrylic esters or a salt thereof, (3) 0.1 to 10% by mole of quaternized compounds of (2), and (4) 0 to 48.5% by mole of (meth)acrylic acid alkyl esters and having the total amount of (2) and (3) of 1.5 to 10% by mole, and obtained by solution polymerization or bulk polymerization (reference to CLAIMS, pages 2 to 3).

(3) Patent Document 3

As an object of decreasing crud generation at the time of polymerization, improving the sizing efficiency and ink-jet printability, and decreasing the foaming property or the like, a cationic surface sizing agent containing (A) cationic copolymers obtained by quaternizing copolymers of hydrophobic monomers and tertiary amino group-containing monomers with oxides, or a cationic surface sizing agent containing copolymers obtained by polymerization (particularly emulsion polymerization: paragraph 25) of (B) hydrophobic monomers such as styrenes and (meth)acrylic esters in the presence of the cationic copolymers (A) are disclosed (reference to claims 1 to 6).

(4) Patent Document 4

As an object of decreasing crud generation at the time of polymerization, improving the sizing efficiency and ink-jet printability, and decreasing the foaming property or the like, disclosed is a cationic surface sizing agent containing copolymers obtained by polymerization (particularly emulsion polymerization: paragraph 29) of (B) hydrophobic monomers such as styrenes and (meth)acrylic esters in the presence of mixtures of cationic copolymers (A-1) obtained by quaternizing copolymers of hydrophobic monomers and tertiary amino group-containing monomers and nonionic surfactants (A-2) (reference to claims 1 to 3).

(5) Patent Document 5

As an object of improving the sizing effect, a surface sizing agent obtained by emulsion polymerization of (C) hydrophobic monomers such as styrenes and (meth)acrylic esters using (B) cationic copolymers obtained by quaternizing (A) copolymers of (a) styrenes and (b) dialkylaminoalkyl(meth) acrylamides as an emulsion dispersant is disclosed.

(6) Patent Document 6

In the above Patent Document 5, those obtained by using (b) dialkylaminoalkyl (meth)acrylates in place of (b) dialkylaminoalkyl(meth)acrylamides in a former clause and monomer mixtures of styrenes and (meth)acrylic ester monomers as the hydrophobic monomers (C) in a latter clause are disclosed.

(7) Patent Document 7

It is disclosed that a sizing agent containing water-soluble or water-dispersive copolymers of styrenes, dialkylaminoalkyl(meth)acrylates and/or dialkylaminoalkyl (meth) acrylamides as constituent monomers is used for transfer paper for electrophotograph containing calcium carbonate as a filler (reference to CLAIMS). In this case, the rate of used styrenes is 40 to 95% by mole (reference to upper right column of page 3).

(8) Patent Document 8

As an object of improving the antirust property and sizing property, a surface sizing agent containing quaternized copolymers composed of 50 to 95% by mole of styrenes and 5 to 50% by mole of dialkylaminoalkyl(meth)acrylamides is disclosed (reference to CLAIMS).

(9) Patent Document 9

Disclosed is a cationic surface sizing agent containing terpolymers in form of an aqueous solution that are composed of 8 to 20% by weight of dimethylaminoethyl (meth)acrylate (a), 45 to 80% by weight of styrene (b), and 8 to 35% by weight of acrylonitrile (c) (preferably 8 to 20% by weight of the component (a), 55 to 75% by weight of the component (b), and 10 to 30% by weight of the component (c)) and are having at least 10% of quaternized dimethylamino groups (reference to claims 1 and 2 in CLAIMS).

Patent Document 1: Japanese Unexamined Patent Publication No. 11-323774

Patent Document 2: Japanese Unexamined Patent Publication No. 4-34097

Patent Document 3: Japanese Unexamined Patent Publication No. 2001-295197

Patent Document 4: Japanese Unexamined Patent Publication No. 2001-262495

Patent Document 5: Japanese Unexamined Patent Publication No. 11-279983

Patent Document 6: Japanese Unexamined Patent Publication No. 11-256496

Patent Document 7: Japanese Unexamined Patent Publication No. 3-167397

Patent Document 8: Japanese Unexamined Patent Publication No. 2-26997

Patent Document 9: Japanese Unexamined Patent Publication No. 56-118994

DISCLOSURE OF THE INVENTION

Problems to be Solved by the Invention

Generally, it is required to apply a large quantity of surface sizing agents in form of an aqueous solution of tertiary amine salts or quaternary ammonium salts of copolymers composed of mainly styrenes and tertiary amino group-containing monomers (that is, cationic monomers) to attain a practical sizing property because of a low sizing effect in a case of using the surface sizing agents for paper or paperboards manufactured without adding a sizing agent and therefore there are problems in terms of cost and coating workability. Particularly in a case of neutral paper, such inconvenience has been rather serious.

Further, copolymers composing a conventional surface sizing agent has been produced by solution polymerization of mainly styrene based monomers and cationic monomers. However, to realize smooth copolymerizability and a good sizing property, since it is required to carry out the solution polymerization in a large quantity of an organic solvent, a large quantity of the organic solvent has to be removed after the organic solvents are made soluble in water and the handling has been complicated and the productivity has been low.

Further, with respect to a cationic surface sizing agent obtained by emulsion polymerization of styrene based monomers and cationic monomers in an aqueous solvent without using an organic solvent or by emulsion polymerization of hydrophobic monomers in an aqueous cationic polymer solution obtained by the solution polymerization, even if the sizing agent is applied to not only sizing agent-free paper, newsprint but also neutral paper using an internal sizing agent, the sizing effect is inferior in comparison with that of a conventional cationic sizing agent obtained by solution polymerization.

The whole agents of the above Patent Documents 1 to 9 are mainly composed of styrenes as hydrophobic monomers and the content thereof is approximately beyond 50% (in Patent Document 9, preferable range is more than 50%). Therefore, the copolymerizability is not always good and if the obtained surface sizing agent is applied to a paper containing no internal addition of a surface sizing agent, it becomes difficult to surely attain a practically useful sizing property.

Further, the sizing agent of Patent Document 2 is emulsion type and the sizing agents of Patent Documents 4 to 6 are produced by emulsion polymerization, so that distribution quantity of application of the sizing agent to the paper surfaces becomes uneven as compared with a sizing agent obtained by solution polymerization and from this point of view, the sizing effect tends to be insufficient.

Furthermore, in a case of Patent Documents 1 and 3, a large quantity of an organic solvent is required to attain copolymerizability smoothly and therefore, a large quantity of the organic solvent has to be removed after the organic solvent is made soluble in water. In sizing agents produced in two-step polymerization manner of carrying out emulsion polymerization of hydrophobic monomers in the presence of cationic copolymers as in the case of Patent Documents 4 to 6, the production process becomes complicated. Since Patent Document 7 has disclosed an internal sizing agent (reference to the upper right column of page 2) and Patent Document 9 discloses a sizing agent containing acrylonitrile as an essential component, they cannot guarantee a sufficient sizing property and easiness of the operating.

The invention provides a cationic surface sizing agent which can enhance a sizing effect even for paper containing no internal sizing agent or containing a little internal sizing agent, and can enhance productivity by being capable of carrying out solution polymerization in a small amount of an organic solvent, and a paper coated with the sizing agent.

Means for Solving the Problem

The inventors of the invention have found the following facts and accordingly have completed the invention. That is, a tertiary amino group-containing monomer, styrenes belonging to hydrophobic monomers, and an alkyl(meth)acrylate at a specified ratio are subjected to solution polymerization in the presence of a chain transfer agent, and particularly the solution polymerization is carried out at a lower content ratio of styrenes than ever before, so that the copolymerizability can be improved even if the amount of the organic solvent is significantly reduced and accordingly molecules are spread smoothly in water and the solubility is increased and consequently a practical sizing property even for paper containing no internal sizing agent can be attained. Since the reaction can be caused with a small amount of the solvent, in a distillation step of the solvent after the solution polymerization, the distillation step itself can be omitted or the distillation time can be shortened. Although it is preferable that the above copolymer be subjected to quaternization in terms of the sizing effect, the effect is almost the same even without the quaternization treatment.

That is, a cationic surface sizing agent of the invention contains a copolymer obtained by solution polymerization of (a) 15 to 35% by weight of a tertiary amino group-containing monomer, (b) 30 to 85% by weight of $C_1$ to $C_4$ alkyl(meth)acrylate, and (c) 1 to 50% by weight of styrenes in an organic solvent in the presence of a chain transfer agent.

The above copolymer is preferably subjected to cationization treatment with a quaternization agent. That is, the cationization treatment can be carried out for the component (a) with 3 to 95% by mole of a quaternization agent to make the copolymer a quaternary ammonium salt.

The above copolymer may further contain (d) 0 to 20% by weight of another copolymerizable vinyl monomer as a constituent monomer.

The paper of the invention is coated with the above cationic surface sizing agent. The invention is preferably applicable to paper containing no internal sizing agent or neutral paper with Stockigt sizing degrees of 2 seconds or less.

Effect of the Invention

In a case of a conventional cationic surface sizing agent containing styrenes and tertiary amino group-containing monomers such as dialkylaminoalkyl(meth)acrylates or dialkylaminoalkyl(meth)acrylamides as main components cannot sufficiently exhibit its hydrophobicity in paper containing no internal sizing agent or having water absorption property with a rather low Stockigt sizing degree and a large quantity of the sizing agents has to be applied to impart a practical sizing property.

It is presumed that at the time of polymerization in the sizing agent, copolymerization of styrenes and the cationic monomers is carried out unevenly and therefore, even if the copolymer is diluted with water to a concentration of a coating solution after the copolymer is water-solubilized to be a quaternary ammonium salt, the copolymer is not completely dissolved in molecular state in the solution but dispersed, and generates a turbidity. Accordingly, if the conventional surface sizing agent is applied to paper, the copolymerized components form agglomerated molecules to exist locally in the paper surface without being completely dissolved and thus they are unevenly distributed.

On the other hand, in the invention, at the time of solution polymerization of a tertiary amino group-containing monomer, a $C_1$ to $C_4$ alkyl-containing alkyl(meth)acrylate, styrenes, and if necessary, another monomer at a specified ratio in the presence of a chain transfer agent, the solution polymerization is carried out particularly at a content ratio of styrenes lower than that of a conventional case. Accordingly, a good sizing effect can be obtained with a common application content even for a paper containing no internal sizing agent or a paper with a considerably low Stockigt sizing degree.

The reason is presumed that the copolymerizability is improved and polymer spread in water is promoted and therefore, the copolymer components are completely dissolved in molecular state when they are diluted with water to a coating level and the hydrophobicity of the surface sizing agent can be distributed evenly on the paper surface.

Further, in terms of the sizing effect, the amino groups of the copolymer of the invention is preferable to be quaternized, however the effect is more or less the same even if the copolymer is as in the tertiary state without being quaternized (reference to Test Example described below). Quaternization of the polymer can draw a good sizing effect in a wider pH range covering from neutral to alkaline.

Furthermore, in a case of an alkyl ketene dimer based surface sizing agent proposed conventionally for neutral paper, there are problems of stains of application apparatuses; however, the surface sizing agent of the invention can solve such problems of stains.

In the invention, since specified types of monomers at a specified ratio are subjected to solution polymerization while the styrenes are decreased, the copolymer to be obtained can be well dissolved even in a small amount of a solvent and polymerization in a high concentration can be carried out. Accordingly, the amount of the solvent needed for the solution polymerization can be saved. That is, since the copolymerizability in the solution polymerization is improved, the solvent distillation removal may be omitted and the obtained copolymer may be used as it is for the surface sizing agent or the solvent can be completely removed or removed to a very slight content within a short time by distillation and thus the distillation step can be simplified (or shortened).

PREFERRED EMBODIMENTS FOR CARRYING OUT THE INVENTION

In the invention, at the time of solution polymerization of a tertiary amino group-containing monomer (a), a $C_1$ to $C_4$ alkyl(meth)acrylate (b), and styrenes (c) at a specified ratio in the presence of a chain transfer agent, the solution polymerization is carried out with a content of the styrenes particularly less than that of a conventional case. If necessary, the obtained copolymer is quaternized to be a quaternary ammonium salt and a surface sizing agent is obtained. This surface sizing agent is applied to paper, particularly paper containing no internal sizing agent or paper containing a very small amount of the internal agent.

The tertiary amino group-containing monomer (a), a constituent component of the copolymer of the invention, is properly one kind compound selected from dialkylaminoalkyl(meth)acrylates and dialkylaminoalkyl(meth)acrylamides. Herein, the alkyl group is preferable to have 1 to 4 carbon atoms.

The above dialkylaminoalkyl(meth)acrylates include such as dimethylaminoethyl(meth)acrylate, dimethylaminopropyl (meth)acrylate, diethylaminoethyl(meth)acrylate, dimethylaminopropyl(meth)acrylate, and diethylaminopropyl(meth) acrylate. Particularly, dimethylaminoethyl(meth)acrylate, diethylaminoethyl(meth)acrylate, and dimethylaminopropyl (meth)acrylate are preferable.

The above dialkylaminoalkyl(meth)acrylamides include such as dimethylaminoethyl(meth)acrylamide, diethylaminoethyl(meth)acrylamide, dimethylaminopropyl(meth)acrylamide, and diethylaminopropyl(meth)acrylamide. Particularly, dimethylaminoethyl(meth)acrylamide and dimethylaminopropyl(meth)acrylamide are preferable.

The $C_1$ to $C_4$ alkyl group containing alkyl(meth)acrylate (b), a constituent component composing the copolymer of the invention includes such as methyl(meth)acrylate, ethyl(meth) acrylate, n-propyl(meth)acrylate, isopropyl(meth)acrylate, n-butyl(meth)acrylate, and isobutyl(meth)acrylate.

In terms of attainment of copolymerizability at the time of solution reaction, it is important that the alkyl(meth)acrylate is a $C_1$ to $C_4$ short chain alkyl ester. In this connection, (meth) acrylate means acrylate or methacrylate.

The above styrenes (c) include styrene, α-methylstyrene, vinyltoluene, ethylvinyltoluene, chloromethylstyrene, and the like.

At the time of polymerization of the copolymer composing the surface sizing agent of the invention, if necessary, another copolymerizable vinyl monomer (d) may be included besides the above components (a) to (c).

The another monomer (d) includes long chain alkyl(meth) acrylates having 5 or more carbon atoms such as 2-ethylhexyl (meth)acrylate and octyl(meth)acrylate; hydroxyl group-containing (meth)acrylates such as hydroxypropyl(meth) acrylate and 2-hydroxyethyl(meth)acrylate; (meth) acrylamide; acrylonitrile and the like.

Accordingly, a copolymer containing the component (a) and also the component (c) and a short chain alkyl ester having 4 or less carbon atoms and a long chain alkyl ester having 5 or more carbon atoms as an alkyl(meth)acrylate is within a scope of the invention since the former is the component (b) and the latter is the component (d). On the other hand, a copolymer containing only a long chain alkyl(meth) acrylate having 5 or more carbon atoms but containing no short chain alkyl ester having 4 or less carbon atoms is out of the scope of the invention.

The ratios of each monomer composing the copolymer of the invention will be described. At first, the content of the tertiary amino group-containing monomer (a) is 15 to 35% by weight and preferably 17 to 30% by weight. If it is less than 15% by weight, the solubility is decreased at the time of water-solubilization and if it exceeds 35% by weight, the hydrophobicity is decreased and the sizing effect is lowered.

The content of the $C_1$ to $C_4$ alkyl group containing alkyl (meth)acrylate (b) is 30 to 85% by weight and preferably 40 to 80% by weight. If it is less than 30% by weight, the hydrophobicity is decreased and at the same time the solubility is lowered at the time of solution polymerization to worsen the copolymerizability. If it exceeds 85% by weight, the ratio of the tertiary amino group-containing monomer becomes too low.

Further, the content of the styrenes (c) is 1 to 50% by weight and preferably 20 to 40% by weight. If it exceeds 50% by weight, the copolymerizability is worsened at the time of solution polymerization. If the copolymerizability is lowered, when the copolymer is water solubilized after solution polymerization, and quaternized to prepare a coating solution, the active principle of the surface sizing agent form agglomerated micro particles and are dotted on the paper surface and cover the surface unevenly to lower the sizing effect.

However, as shown in evaluation Test Examples described below (reference to Example 2, Examples 4 and 5), styrenes (c) are more excellent in the hydrophobicity than alkyl(meth) acrylate, addition of a proper amount to the copolymer is allowed without any problem.

Furthermore, the another monomer (d) may be used if necessary, and the content thereof is 0 to 20% by weight and preferably 0 to 15% by weight.

The copolymer of the invention can be produced by solution polymerization of the components (a) to (c) and if necessary, the component (d) as constituent monomers in an organic solvent (reference to an evaluation Test Example described below (Comparative Example 5)).

The above organic solvent includes oxygen-containing hydrocarbons such as alcohols, ketones, and the like and aromatic hydrocarbons such as toluene.

Specifically, the organic solvent includes isopropyl alcohol, n-butanol, isobutanol, t-butanol, sec-butanol, acetone, methyl ethyl ketone, methyl n-propyl ketone, 3-methyl-2-butanol, diethyl ketone, methyl isopropyl ketone, methyl isobutyl ketone, diisopropyl ketone, ethylbenzene, toluene and the like. In terms of environmental preservation and industrial health, isopropyl alcohol, n-butanol, isobutanol, methyl isobutyl ketone, diisopropyl ketone and the like are preferable.

In the invention, the types of the monomer components and contents thereof are specified to improve the copolymerizability and the amount of the required solvent is decreased, and the reduction of the solvent amount contributes to improvement in an environmental sphere. A proper amount of the used organic solvent is 30% by weight or lower, and preferably 20% by weight or lower based on the entire monomers.

In the invention, from a viewpoint that the polymerization reaction is smoothly carried out by preventing increase of the viscosity at the time of solution polymerization, it is necessary to carry out the polymerization in the presence of a chain transfer agent (reference to an evaluation Test Example described below (Comparative Example 7)). As the above chain transfer agent, any of oil-soluble and water-soluble chain transfer agents may be used. In a case of carrying out the polymerization in an oleophilic organic solvent, an oil-soluble chain transfer agent is preferable and on the other hand, in a case of using a hydrophilic organic solvent, a water-soluble chain transfer agent is relatively preferable.

The above oleophilic chain transfer agent includes mercaptans such as t-dodecyl mercaptan, n-dodecyl mercaptan, n-octyl mercaptan, mercaptopropionic acid dodecyl ester and the like; and additionally, cumene, carbon tetrachloride, α-methylstyrene dimer, terpinolene, and the like.

The above water-soluble chain transfer agent includes mercaptoethanol, thioglycolic acid and a salt thereof.

The amount of the used chain transfer agent is preferably 1 to 5% by weight based on the monomers, however it is not limited to this range.

An initiator to be used for the solution polymerization includes benzoyl persulfate, azobisisobutyronitrile, t-butyl peroxybenzoate, t-butylperoxyisopropyl monocarbonate, t-butyl peroxy-2-ethylhexanoate, cumene hydroperoxide and the like.

As described, in the invention, the solution polymerization is carried out in the organic solvent in the presence of the chain transfer agent and the initiator; however the solution polymerization may be carried out by a conventional manner and is not particularly limited.

The copolymer obtained by solution polymerization of the above components (a) to (c) as constituent monomers and if necessary the component (d) may be subjected to cationization treatment with a quaternization agent. However, in the invention, the obtained copolymer in which the amino groups are in the tertiary state may be used as it is for the cationic surface sizing agent without quaternization.

As the above quaternization agent, for example, one or two or more kinds of dimethylsulfuric acid, methyl chloride, allyl chloride, benzyl chloride, propylene oxide, butylene oxide, styrene oxide, epichlorohydrin, epibromohydrin, ethylenechlorohydrin, and the like can be used.

The amount of the used quaternization agent is 3 to 95% by mole and preferably 30 to 90% by mole based on the tertiary amino group-containing monomer (a) in terms of smooth cationization of the copolymer.

The quaternization of the copolymer can cause a good sizing effect in a wide pH range covering from a neutral side to an alkaline side.

The quaternization treatment can be carried out generally by carrying out solubilization of the cationic copolymer, successively removing the solvent, and quaternizing the copolymer, however the solvent removal may be carried out after quaternization.

In terms of smooth solution polymerization, the quaternization treatment is basically carried out by cationization treatment with a quaternization agent after copolymerization of the constituent monomers including the tertiary amino group-containing monomer (a). However, the tertiary amino group-containing monomer (a) may previously be quaternized and the obtained quaternary ammonium salt group-containing monomer may be copolymerized. In this case, the polymerization condition (of the quaternary monomer) is similar to the treatment condition for a case of polymerization of the tertiary monomer.

The invention provides various types of paper obtained by coating the above cationic surface sizing agent to base papers. The surface sizing agent of the invention may be applicable widely regardless of acidic paper using aluminum sulfate as a fixation agent, neutral paper containing calcium carbonate as a filler, and the like.

Specific examples of the base paper may be newsprint paper, paper for ink-jet printing, thermosensitive recording base paper, pressure-sensitive recording base paper, fine paper, paperboard, and other types of paper. The surface sizing agent of the invention is characterized in that the agent does not basically require a combination with an internal sizing agent and therefore, the base paper is preferably paper containing no internal sizing agent (regardless of acidic paper and neutral paper) or neutral paper having the Stockigt sizing degree of 2 seconds or less. However, the surface sizing agent of the invention is not excluded applications for a paper containing an internal sizing agent.

In a case of applying the surface sizing agent of the invention, the amount of the deposited sizing agent differs according to the type of paper, and a high concentration coating solution may be applied in the small amount of applications or a low concentration coating solution may be applied in the many amount of applications to change the deposition state. Further, the application may be either one-side application or both-side application. Accordingly, the amount of the deposited surface sizing agent is not particularly limited and it may be generally about 0.01 to 0.2 $g/m^2$ and preferably about 0.02 to 0.1 $g/m^2$.

Further, at the time of application, it is no need to say that the surface sizing agent of the invention can be used in combination with a paper surface strength agent such as starches, polyvinyl alcohol, and polyacrylamide as well as an anti-slippage agent, a release agent, an antirust agent, an antiseptics, and other additives.

EXAMPLES

Hereinafter, Examples of a cationic surface sizing agent of the invention, sizing property evaluation Test Examples in a case the sizing agents are applied to a neutral fine paper and a newsprint will be successively described. In Examples and Test Examples, "part(s)" and "%" are based on weight unless otherwise specified.

Additionally, the invention should not be limited to the following Examples and the Test Examples.

<Examples of Surface Sizing Agents>

Examples 1 to 6 described below can be summarized as follows.

Example 1 is an example that the amount of a tertiary amino group-containing monomer (a) is near the lower limit of the proper amount of the invention:

Example 2 is an example that styrene (c) is in an amount of 5% and an alkyl (meth)acrylate (b) is in a relatively large amount:

Example 3 is an example that the amount of styrene (c) is near the upper limit and the amount of the component (b) is near the lower limit:

Example 4 is an example that the component (a) is near the upper limit: and Example 5 is an example that a quaternization agent after copolymerization is in a very small amount.

Examples 4 and 5 are examples that the components (a) to (c) are all within preferable ranges of the invention or near the ranges.

Examples 2 and 5 are examples of omitting the distillation step by saving the solvent amount and other Examples are examples of removing the solvents.

Examples 2 and 4 are examples of using another component (d).

Examples 1 to 5 are examples of carrying out quaternization of the copolymers and Examples 6 is an examples of carrying out no quaternization treatment.

On the other hand, Comparative Examples below can be summarized as follows.

Comparative Example 1 is an example that a conventional surface sizing agent uses no alkyl(meth)acrylate (b) but uses a large amount of styrene (c):

Comparative Example 2 is an example that styrene (c) is in an amount higher than a proper amount of the invention and the component (b) is in an amount lower than a proper amount:

Comparative Example 3 is an example that the tertiary amino group-containing monomer (a) is in an amount lower than a proper amount:

Comparative Example 4 is an example that a cationic monomer: a hydrophobic monomer=40 parts:60 parts and each component (a) and (c) is in amount higher than proper amount and the component (b) is in a lower amount:

Comparative Example 5 is an example that emulsion polymerization of the components (a) to (c) is carried out in a proper ratio:

Comparative Example 6 is an example that styrene (c) is 0%, the tertiary amino group-containing monomer (a) is in an amount exceeding the proper amount of the invention, and the hydrophobic monomer (b) is within a proper range:

Comparative Example 7 is an example that solution polymerization is carried out using no chain transfer agent:

Comparative Example 8 is an example that a C5 or higher long chain alkyl (meth)acrylate is contained in place of the component (b) and the components (a) to (c) are within a proper range in a case that the long chain (meth)acrylate is contained as the component (b):

Comparative Example 9 is an example that a surface sizing agent contains 45% by weight of styrene, no alkyl(meth) acrylate (b), and containing acrylonitrile as a constituent monomer in accordance with the Patent Document 9 described before.

Comparative Example 10 is an example that no quaternization treatment is carried out to the copolymer basically according to Comparative Example 1: and Comparative Examples 1 to 9 are examples that quaternization treatment is carried out.

Example 1

A four-neck flask was loaded with 43 parts of isobutyl acrylate, 25 parts of methyl methacrylate, 15 parts of styrene, 17 parts of dimethylaminoethyl methacrylate and further 2 parts of t-dodecyl mercaptan as a chain transfer agent and 18 parts of n-butanol and heated to 100° C., and 2 parts of azoisobutyronitrile (hereinafter, referred to as AIBN) was added as an initiator to carry out polymerization at 100° C. for 3 hours.

Next, 250 parts of water and 6.4 parts of acetic acid were added for water-solubilization and thereafter, heat distillation was carried out to remove n-butanol in 1 hour. After 9.0 parts of epichlorohydrin was added at 89° C., reaction was carried out for 4 hours and the reaction product was cooled and diluted with water to obtain a surface sizing agent in form of a light yellow transparent liquid containing 20% of solid matter.

Example 2

A four-neck flask was loaded with 5 parts of styrene, 55 parts of n-butyl methacrylate, 10 parts of 2-ethylhexyl methacrylate, 30 parts of dimethylaminopropylacrylamide and further 2 parts of t-dodecyl mercaptan as a chain transfer agent, 7 parts of isopropyl alcohol and 15 parts of 90% acetic acid and heated to 100° C., and 2 parts of AIBN was added as an initiator to carry out polymerization at 90° C. for 3 hours.

Next, without solvent distillation, 250 parts of water was added for water-solubilization and thereafter, 9.7 parts of dimethylsulfuric acid was added at 85° C., reaction was carried out for 3 hours and the reaction product was cooled and diluted with water to obtain a surface sizing agent in form of a light yellow transparent liquid (the amount of remaining solvent 1.2%) containing 20% of solid matter.

Example 3

A four-neck flask was loaded with 36 parts of isobutyl acrylate, 44 parts of styrene, 20 parts of dimethylaminoethyl methacrylate, and further 2 parts of t-dodecyl mercaptan as a chain transfer agent and 18 parts of diisopropyl ketone and heated to 110° C., and 2 parts of t-butylperoxy benzoate was added as an initiator to carry out polymerization at 110° C. for 3 hours.

Next, 250 parts of water and 7.6 parts of acetic acid were added for water-solubilization and thereafter, heat distillation was carried out to remove diisopropyl ketone in 1 hour. After that, 5.9 parts of epichlorohydrin was added at 85° C. and successively reaction was carried out for 3 hours and the reaction product was cooled and diluted with water to obtain a surface sizing agent in form of a light yellow transparent liquid containing 20% of solid matter.

Example 4

A four-neck flask was loaded with 38 parts of isobutyl methacrylate, 20 parts of styrene, 10 parts of hydroxypropyl methacrylate, 32 parts of dimethylaminoethyl methacrylate, and further 2 parts of t-dodecyl mercaptan as a chain transfer agent and 15 parts of isopropyl alcohol and heated to 90° C., and 2 parts of AIBN was added as an initiator to carry out polymerization at 90° C. for 3 hours.

Next, 250 parts of water and 13.5 parts of acetic acid were added for water-solubilization and thereafter, heat distillation was carried out to remove isopropyl alcohol in 0.5 hours. After that, 9.5 parts of epichlorohydrin was added at 85° C. and successively reaction was carried out for 3 hours and the reaction product was cooled and diluted with water to obtain a surface sizing agent in form of a light yellow transparent liquid containing 20% of solid matter.

Example 5

A four-neck flask was loaded with 25 parts of n-butyl methacrylate, 25 parts of methyl methacrylate, 30 parts of styrene, 20 parts of dimethylaminoethyl methacrylate and further 2 parts of t-dodecyl mercaptan as a chain transfer agent, 5 parts of isopropyl alcohol and 10 parts of 90% acetic acid and heated to 90° C., and 2 parts of AIBN was added as an initiator to carry out polymerization at 90° C. for 3 hours.

Next, without solvent distillation, 250 parts of water was added for water-solubilization and thereafter, 0.7 parts of epichlorohydrin was added at 85° C. and successively reaction was carried out for 3 hours and the reaction product was cooled and diluted with water to obtain a surface sizing agent in form of a light yellow transparent liquid (the amount of remaining solvent 0.9%) containing 20% of solid matter.

Example 6

A four-neck flask was loaded with 25 parts of n-butyl methacrylate, 25 parts of methyl methacrylate, 30 parts of styrene, 20 parts of dimethylaminoethyl methacrylate and further 2 parts of t-dodecyl mercaptan as a chain transfer agent, 5 parts of isopropyl alcohol and 10 parts of 90% acetic acid and heated to 90° C., and 2 parts of AIBN was added as an initiator to carry out polymerization at 90° C. for 3 hours.

Next, without solvent distillation, 250 parts of water was added for water-solubilization and thereafter, the reaction product was cooled and diluted with water to obtain a surface sizing agent in form of a light yellow transparent liquid (the amount of remaining solvent 0.9%) containing 20% of solid matter.

Comparative Example 1

A four-neck flask was loaded with 75 parts of styrene, 25 parts of dimethylaminoethyl methacrylate and further 2 parts of t-dodecyl mercaptan as a chain transfer agent and 70 parts of isopropyl alcohol and heated to 80° C., and 2 parts of AIBN was added as an initiator to carry out polymerization for 3 hours under refluxing condition.

Next, 250 parts of water and 9.6 parts of acetic acid were added for water-solubilization and thereafter, heat distillation was carried out to remove isopropyl alcohol. The distillation took 3 hours. Thereafter, 14.1 parts of epichlorohydrin was added at 85° C. and successively reaction was carried out for 3 hours and the reaction product was cooled and diluted with water to obtain a surface sizing agent in form of a slightly yellow and slightly turbid liquid.

Comparative Example 2

A four-neck flask was loaded with 15 parts of isobutyl methacrylate, 55 parts of styrene, 30 parts of dimethylaminoethyl methacrylate and in addition, further 2 parts of t-dodecyl mercaptan as a chain transfer agent and 70 parts of toluene and heated to 110° C., and 2 parts of t-butylperoxybenzoate was added as an initiator to carry out polymerization for 3 hours under refluxing condition.

Next, 250 parts of water and 11.4 parts of acetic acid were added for water-solubilization and thereafter, heat distillation was carried out to remove toluene. The distillation took 2.5 hours. Thereafter, 16.9 parts of epichlorohydrin was added at 85° C. and successively reaction was carried out for 3 hours and the reaction product was cooled and diluted with water to obtain a surface sizing agent in form of a slightly yellow and slightly turbid liquid.

Comparative Example 3

A four-neck flask was loaded with 48 parts of n-butyl methacrylate, 30 parts of methyl methacrylate, 10 parts of styrene, 12 parts of dimethylaminoethyl methacrylate and in addition, further 2 parts of t-dodecyl mercaptan as a chain transfer agent and 25 parts of isopropyl alcohol and heated to 90° C., and 2 parts of AIBN was added as an initiator to carry out polymerization at 90° C. for 3 hours.

Next, 250 parts of water and 4.6 parts of acetic acid were added for water-solubilization and thereafter, heat distillation was carried out to remove isopropyl alcohol. The distillation took 1.0 hour. Thereafter, 5.8 parts of epichlorohydrin was added at 85° C. and successively reaction was carried out for 3 hours and the reaction product was cooled and diluted with water to obtain a surface sizing agent in form of a slightly yellow and slightly turbid liquid.

Comparative Example 4

A four-neck flask was loaded with 5 parts of n-butyl methacrylate, 55 parts of styrene, 40 parts of dimethylaminoethyl methacrylate and in addition, further 2 parts of t-dodecyl mercaptan as a chain transfer agent and 60 parts of n-butanol and heated to 100° C., and 2 parts of t-butylperoxypropyl monocarbonate was added as an initiator to carry out polymerization at 100° C. for 3 hours.

Next, 250 parts of water and 15.3 parts of acetic acid were added for water-solubilization and thereafter, heat distillation was carried out to remove n-butanol. The distillation took 3 hours. Thereafter, 22.5 parts of epichlorohydrin was added at 85° C. and successively reaction was carried out for 3 hours and the reaction product was cooled and diluted with water to obtain a surface sizing agent in form of a slightly yellow and slightly turbid liquid.

Comparative Example 5

A four-neck flask was loaded with 36 parts of isobutyl acrylate, 44 parts of styrene, 20 parts of dimethylaminoethyl methacrylate and in addition, further 2 parts of t-dodecyl mercaptan as a chain transfer agent, 220 parts of ion-exchanged water, and 4 parts of octadecylamine acetic acid salt as an emulsifier and heated to 55° C., and after 2,2'-azobis(2-amidinopropane) dihydrochloride as an initiator was added, the mixture was heated to 85° C. and emulsion polymerization was carried out at the temperature of 85° C. for 3 hours.

Next, 40 parts of water and 7.6 parts of acetic acid were added for water-solubilization and thereafter, 5.9 parts of epichlorohydrin was added at 85° C. and successively reaction was carried out for 3 hours and the reaction product was cooled and diluted with water to obtain a surface sizing agent in form of a light yellow and slightly turbid liquid.

Comparative Example 6

A four-neck flask was loaded with 30 parts of n-butyl methacrylate, 30 parts of methyl methacrylate, 40 parts of dimethylaminoethyl methacrylate and in addition, further 2 parts of n-dodecyl mercaptan as a chain transfer agent and 25 parts of isopropyl alcohol and heated to 90° C., and 2 parts of AIBN was added as an initiator to carry out polymerization at 90° C. for 3 hours.

Next, 250 parts of water and 15.3 parts of acetic acid were added for water-solubilization and thereafter, heat distillation was carried out to remove isopropyl alcohol. The distillation took 1.0 hour. Thereafter, 18.8 parts of epichlorohydrin was added at 85° C. and successively reaction was carried out for 3 hours and the reaction product was cooled and diluted with water to obtain a surface sizing agent in form of a slightly yellow and slightly turbid liquid.

Comparative Example 7

According to the above Example 1, solution polymerization was carried out without using t-dodecyl mercaptan as a chain transfer agent, however during the operation, viscosity was increased and gelation occurred to make it impossible to continue the reaction and thus no surface sizing agent was obtained.

Comparative Example 8

A four-neck flask was loaded with 35 parts of 2-ethylhexyl methacrylate, 35 parts of styrene, 30 parts of dimethylaminopropylacrylamide, and in addition, further 2 parts of t-dodecyl mercaptan as a chain transfer agent, 7 parts of isopropyl alcohol, and 15 parts of 90% acetic acid and heated to 100° C., and 2 parts of AIBN was added as an initiator to carry out polymerization at 90° C. for 3 hours.

Next, without heat distillation, 250 parts of water was added for water-solubilization and thereafter, 9.7 parts of dimethylsulfuric acid was added at 85° C. and successively reaction was carried out for 3 hours and the reaction product was cooled and diluted with water to obtain a surface sizing agent in form of a light yellow and slightly turbid liquid (the amount of remaining solvent 1.2%) containing 20% of solid matter.

Comparative Example 9

An autoclave was loaded with 45 parts of styrene, 25 parts of acrylonitrile, 30 parts of dimethylaminoethyl methacrylate, and further 2 parts of t-dodecyl mercaptan as a chain transfer agent and 15 parts of isopropyl alcohol and heated to 80° C., and 2 parts of AIBN was added as an initiator to carry out polymerization at 80° C. for 3 hours.

Next, 250 parts of water and 13.5 parts of acetic acid were added for water-solubilization and thereafter, heat distillation was carried out to remove isopropyl alcohol in 0.5 hours. Thereafter, 9.5 parts of epichlorohydrin was added at 85° C. and successively reaction was carried out for 3 hours and the reaction product was cooled and diluted with water to obtain a surface sizing agent in form of a light yellow and slightly turbid liquid containing 20% of solid matter.

Comparative Example 10

A four-neck flask was loaded with 75 parts of styrene, 25 parts of dimethylaminoethyl methacrylate, and 2 parts of t-dodecyl mercaptan as a chain transfer agent and 70 parts of isopropyl alcohol and heated to 80° C., and 2 parts of AIBN was added as an initiator to carry out polymerization for 3 hours under refluxing condition.

Next, 250 parts of water and 9.6 parts of acetic acid were added for water-solubilization and thereafter, heat distillation was carried out to remove isopropyl alcohol. The distillation took 3 hours. Thereafter, the reaction product was cooled and diluted with water to obtain a surface sizing agent in form of a slightly yellow and slightly turbid liquid.

Thereafter, each surface sizing agent obtained in Examples 1 to 6 and Comparative Examples 1 to 10 as described above was applied to a neutral fine paper containing no internal sizing agent to carry out a sizing property evaluation test. Further, a blank example using no surface sizing agent of the invention was performed as Comparative Example 11.

In addition, since no sizing agent was obtained due to viscosity increase and gelation of the copolymer at the time of solution polymerization in Comparative Example 7, it could not be subjected to the following evaluation test.

<Examples of Sizing Property Evaluation Test of Surface Sizing Agents to Neutral Fine Paper>

Each surface sizing agent of Examples 1 to 6 and Comparative Examples 1 to 10 (excluding Comparative Example 7) was dissolved in a gelatinized solution of oxidized starch (MS-3800: manufactured by Nihon Shokuhin Kako Co., Ltd.) to prepare two type coating solutions, respectively as shown in Table 1.

TABLE 1

| | Oxidized starch | Surface sizing agent |
|---|---|---|
| Coating solution A | 6.0% by weight | 0.4% by weight |
| Coating solution B | 6.0% by weight | 0.6% by weight |

On the other hand, light calcium carbonate in an amount of 5%, aluminium sulfate in an amount of 0.5%, and cationized starch in an amount of 0.5% based on a pulp were added to LBKP pulp slurry beaten to 450 mL (c.s.f) to carry out wet paper manufacturing without using an internal sizing agent and obtained a neutral paper (paper weight 75 g/m$^2$).

A coating solution was applied such that the amount of absorbed solution is 20 g/m$^2$ in both faces to each face of the internal sizing agent-free neutral paper by a bar coater and the paper was dried by passing through a rotary type drum drier at 90° C. for 90 seconds to obtain a neutral fine coated paper.

Each sizing degree of the neutral fine coated paper was measured according to "Method of Testing Stockigt Sizing Degree of Paper" of JIS P8122. The test results are shown in Table 2.

TABLE 2

| | Stockigt sizing degree | |
|---|---|---|
| | Sizing agent concentration in coating solution 0.4% (sec) | Sizing agent concentration in coating solution 0.6% (sec) |
| Example 1 | 8 | 15 |
| Example 2 | 7 | 12 |
| Example 3 | 8 | 18 |
| Example 4 | 10 | 22 |
| Example 5 | 8 | 17 |
| Example 6 | 6 | 11 |
| Comparative Example 1 | 3 | 6 |
| Comparative Example 2 | 4 | 8 |
| Comparative Example 3 | 3 | 7 |
| Comparative Example 4 | 3 | 7 |
| Comparative | 3 | 7 |

TABLE 2-continued

| | Stockigt sizing degree | |
|---|---|---|
| | Sizing agent concentration in coating solution 0.4% (sec) | Sizing agent concentration in coating solution 0.6% (sec) |
| Example 5 | | |
| Comparative Example 6 | 3 | 6 |
| Comparative Example 7 | — | — |
| Comparative Example 8 | 2 | 6 |
| Comparative Example 9 | 4 | 7 |
| Comparative Example 10 | 0 | 8 |
| Comparative Example 11 | 0 | 0 |

* Comparative Example 11 is an example using no surface sizing agent.

A case the coating solution concentration was 0.4% will be discussed. In Comparative Example 11, a blank example without coating with the surface sizing agent of the invention, the sizing of the neutral paper containing no internal sizing agent was 0 second. In Comparative Example 1 coated with a conventional type surface sizing agent containing a large quantity of styrenes (example of quaternized copolymer), it was 3 seconds, and in Comparative Example 10 (example of no quaternization treatment), it was 0 second.

On the other hand, in Examples 1 to 6 coated with the surface sizing agents of the invention, all showed the sizing degree in a range of 6 to 10 seconds and accordingly it was confirmed that the sizing effect was efficiently improved.

Accordingly, it was confirmed that if there were a large quantity of styrenes in the monomer compositions of the copolymers, the sizing effect was lowered and that the sizing effect was improved by suppressing the amount of the styrenes within a proper range of the invention.

Comparative Example 2 (styrenes (c) were less than those in Comparative Example 1, however they exceeded in a proper range of the invention and the alkyl (meth)acrylate (b) was less than a proper range) and Comparative Example 3 (styrenes were decreased and the alkyl(meth)acrylate (b) was increased within the proper range of the invention and at the same time the tertiary amino group-containing monomer (a) was less than the proper range of the invention) were both inferior to the sizing (3 to 4 seconds) as similar as Comparative Example 1.

Further, in Comparative Example 4, since the content of styrenes (c) was similar to that of Comparative Example 2 and the alkyl(meth)acrylate (b) was less than the proper range of the invention and the tertiary amino group-containing monomer (a) was excess, the sizing was as low as that in Comparative Example 1.

In comparison of these Comparative Examples with Examples, it was confirmed that unless the compositions of the components (a) to (c) composing the copolymers were in proper ranges, no sizing effect improvement could be expected.

In addition, in Comparative Example 6, though the content of styrene was 0% and the copolymer was composed of only the components (a) and (b), since the component (a) was higher than the proper amount of the invention and the hydrophobic monomer (b) was less than the proper amount of the invention, the water repellent property, which was base as a sizing agent, was lowered. It is an evidence in support of the importance that the compositions of the components (a) to (c) are within the proper ranges to improve the sizing.

Since the sizing property of Comparative Example 5 in which the ratios of the components (a) and (b) were proper but emulsion polymerization was carried out in place of solution polymerization was inferior, importance of solution polymerization of the copolymer for improvement of the sizing effect was confirmed.

Further, in Comparative Example 7 using no chain transfer agent, the sizing agent itself could not be obtained due to increase of the viscosity, and therefore it is confirmed that the chain transfer agent is essential at the time of solution polymerization.

In Comparative Example 8 in which the ratios of the components (a) to (c) were proper but the alkyl(meth)acrylate (b) was not a short chain alkyl ester with 4 or less carbon atoms but a long chain alkyl(meth)acrylate with 5 or more carbon atoms, the sizing was inferior (2 seconds) and therefore, it was confirmed that the alkyl (meth)acrylate (b) is necessarily required to be a short chain alkyl ester with 4 or less carbon atoms.

In addition, Comparative Example 9 was according to the above Patent Document 9 and as compared with a conventional agent, the styrene ratio was as relatively low as 45%, however no alkyl(meth)acrylate (b) was contained and acrylonitrile was contained as an essential component, and therefore, the sizing property was almost the same as that of Comparative Example 2.

On the other hand, Examples 1 to 6 will be described. Since the sizing was improved in Examples other than Example 2 in which the styrene content was 5%, in order to improve the sizing effect, it is preferable to use styrenes (c) in combination with the alkyl(meth)acrylate (b) as hydrophobic monomers.

In Examples 4 and 5 in which the contents of components (a) to (c) were within preferable ranges or near the range, relatively desirable sizing effects were caused and the sizing property of Example 4 was particularly excellent.

Further, even in Examples 2 and 5 in which the solvent distillation step was omitted, practically applicable sizing could be achieved. Particularly, the sizing agent of Example 5 was not only excellent in the sizing property but also effective to improve the productivity in terms of extremely small amount of the remaining solvent without distillation removal of the solvent.

Moreover, in comparison of Examples 1 to 5 in which the copolymers were quaternized with Example 6 in which the copolymer was not quaternized, as described above, it was confirmed that the sizing effect was efficiently improved in Example 6 compared with Comparative Examples, and the sizing effect was more efficiently improved in Examples 1 to 5 than Example 6.

In a case where the coating solution concentration was increased to 0.6%, the superiority of the sizing degree of Examples 1 to 6 to Comparative Examples 1 to 10 was similar to the case where the concentration was 0.4%.

Further, if the coating solution concentration was increased to 0.6%, the sizing degree of Examples 1 to 6 was drastically improved and many cases showed numeral values beyond 2 times as high as those of the case of 0.4%.

Next, in each surface sizing agent obtained in the above Examples and Comparative Examples, a sizing property evaluation test of the surface sizing agent to a newsprint containing no internal sizing agent was carried out. Comparative Example 12 was a blank example using no surface sizing agent of the invention.

In addition, Comparative Example 7 could not be subjected to the evaluation test due to viscosity increase and gelation of the copolymer in the same as this test.

<Examples of Sizing Property Evaluation Test of Surface Sizing Agents to Newsprint>

Each surface sizing agent of Examples 1 to 6 and Comparative Examples 1 to 10 (excluding Comparative Example 7) was dissolved in a gelatinized solution of oxidized starch (MS-3800: manufactured by Nihon Shokuhin Kako Co., Ltd.) to prepare two type coating solutions, respectively as shown in Table 3.

TABLE 3

| | Oxidized starch | Surface sizing agent |
|---|---|---|
| Coating solution C | 3.0% by weight | 0.2% by weight |
| Coating solution D | 3.0% by weight | 0.3% by weight |

On the other hand, paper materials containing waste paper and machine pulp in an amount of 80% by weight or more in the entire pulp components were used and wet paper-manufactured using no internal sizing agent to obtain calcium carbonate-containing paper (base paper) for newsprint.

A coating solution was applied such that the amount of absorbed solution is 14 g/m$^2$ in both faces to each face of the above base paper by a bar coater and the paper was dried by passing through a rotary type drum drier at 80° C. for 60 seconds to obtain a both-side coated newsprint.

Each coated newsprint was subjected to a water-absorbing test with 5 μL of water according to JAPAN TAPPI Test Method No. 32-2 (Method of Testing Paper-Water Absorption-Second section: Dripping method) to measure time required for the water absorption. The test results are shown in Table 4.

TABLE 4

| Water-absorbing test (Water: 5 μL) | | |
|---|---|---|
| | Sizing agent concentration in coating solution 0.2% (sec) | Sizing agent concentration in coating solution 0.3% (sec) |
| Example 1 | 45 | 141 |
| Example 2 | 48 | 150 |
| Example 3 | 48 | 152 |
| Example 4 | 54 | 177 |
| Example 5 | 49 | 160 |
| Example 6 | 44 | 135 |
| Comparative Example 1 | 35 | 65 |
| Comparative Example 2 | 38 | 81 |
| Comparative Example 3 | 36 | 75 |
| Comparative Example 4 | 36 | 72 |
| Comparative Example 5 | 32 | 71 |
| Comparative Example 6 | 34 | 70 |
| Comparative Example 7 | — | — |
| Comparative Example 8 | 35 | 76 |
| Comparative Example 9 | 36 | 74 |
| Comparative Example 10 | 30 | 60 |
| Comparative Example 12 | 22 | 23 |

* Comparative Example 12 is an example using no surface sizing agent.

In this newsprint test, similarly to the above neutral fine paper test, Examples 1 to 6 showed more excellent sizing property than Comparative Examples 1 to 10.

That is, Examples 1 to 6 were not only more excellent in the sizing property than Comparative Example 12, a blank example using no surface sizing agent, but also similarly superior in the sizing degree to Comparative Example of conventional type with a high styrene content, Comparative Example in which the contents of components (a) to (c) were out of proper ranges, Comparative Example in which a long chain ester was used in place of the component (b), or Comparative Example in which emulsion polymerization was carried out.

Further, in relation to the concentration of the coating solutions, only a slight increase from 0.2% to 0.3% led the sizing degree to increase numeral values beyond three times and therefore, it was confirmed that the sizing effect could be drastically improved.

Moreover, similarly to the above Test Example of the neutral paper, it was confirmed that Example 6 in which the copolymer was not quaternized was apparently improved in the sizing effect as compared with Comparative Examples. On the other hand, it was confirmed that Examples 1 to 5 in which the copolymers were quaternized were furthermore improved in the sizing effect than Example 6.

As described above, it is made clear that the surface sizing agent of the invention can cause excellent sizing effect on neutral fine paper and newsprint by applying singly sizing agent without a combination with an internal sizing agent (that is, even on base paper containing no internal sizing agent).

Although preferred embodiments of the invention are described above, it is no need to say that modifications and substitutions can be made within a scope of the invention.

The invention claimed is:

1. A cationic surface sizing agent comprising a copolymer obtained by solution polymerization of (a) 15 to 35% by weight of a tertiary amino group-containing monomer, (b) 30 to 85% by weight of $C_1$ to $C_4$ alkyl(meth)acrylate, and (c) 1 to 50% by weight of styrenes, (d) 0 to 20% by weight of another copolymerizable vinyl monomer, in an organic solvent in the presence of a chain transfer agent, wherein the amount of the chain transfer agent is 1 to 5% by weight based on the monomers.

2. The cationic surface sizing agent according to claim 1, wherein said copolymer is subjected to cationization treatment with a quaternization agent.

3. The cationic surface sizing agent according to claim 1, wherein said tertiary amino group-containing monomer (a) is at least one selected from dialkylaminoalkyl(meth)acrylate and dialkylaminoalkyl(meth)acrylamide.

4. The cationic surface sizing agent according to claim 2, wherein the copolymer is subjected to a quaternary ammonium salt by a quaternization agent in an amount of 3 to 95% by mole based on the component (a).

5. Paper products coated with the cationic surface sizing agent according to claim 1.

6. The paper products according to claim 5 being paper containing no internal sizing agent or neutral paper having Stockigt sizing degree of 2 seconds or less.

* * * * *